US007059157B2

(12) United States Patent
Morita et al.

(10) Patent No.: US 7,059,157 B2
(45) Date of Patent: Jun. 13, 2006

(54) STITCH PRESSER IN A WEFT KNITTING MACHINE

(75) Inventors: Toshiaki Morita, Wakayama (JP); Toshinori Nakamori, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 10/543,558

(22) PCT Filed: Feb. 2, 2004

(86) PCT No.: PCT/JP2004/001017

§ 371 (c)(1),
(2), (4) Date: Jul. 27, 2005

(87) PCT Pub. No.: WO2004/070099

PCT Pub. Date: Aug. 19, 2004

(65) Prior Publication Data

US 2006/0090519 A1 May 4, 2006

(30) Foreign Application Priority Data

Feb. 5, 2003 (JP) ..... 2003-028122

(51) Int. Cl.
*D04B 7/04* (2006.01)

(52) U.S. Cl. ..... 66/90; 66/64

(58) Field of Classification Search ..... 66/90, 66/95, 96 R, 104, 109, 110
See application file for complete search history.

(56) References Cited

U.S. PATENT DOCUMENTS

| | | | | |
|---|---|---|---|---|
| 4,442,683 | A * | 4/1984 | Shima et al. | 66/64 |
| 4,501,132 | A * | 2/1985 | Flavell et al. | 66/64 |
| 4,516,411 | A * | 5/1985 | Hampson | 66/64 |
| 4,852,369 | A * | 8/1989 | Stoppazzini | 66/64 |
| 5,063,755 | A | 11/1991 | Shima et al. | |
| 5,280,712 | A | 1/1994 | Nakamori et al. | |
| 5,415,016 | A * | 5/1995 | Hirai et al. | 66/109 |
| 6,079,233 | A | 6/2000 | Shima | |
| 6,119,486 | A | 9/2000 | Morita et al. | |

* cited by examiner

*Primary Examiner*—Danny Worrell
(74) *Attorney, Agent, or Firm*—Wenderoth, Lind & Ponack, L.L.P.

(57) ABSTRACT

A stitch presser in a weft knitting machine installed on a carriage that slides in a reciprocating fashion on a needle bed and configured such that a presser bar fitted through a presser bar supporting arm joined to a rotation shaft of a motor is advanced into a mouth portion of the weft knitting machine with an electric power supplied to the motor driving the predetermined presser bar in conjunction with the directional switching of the reciprocating motion of the carriage, including a rotation energizing mechanism for rotating the rotating shaft of the motor to a side retracting the presser bar of the weft knitting machine when the electric power is not supplied to the motor for driving the presser bar advanced into the mouth portion.

2 Claims, 7 Drawing Sheets

STITCH PRESSER IN A WEFT KNITTING MACHINE

TECHNICAL FIELD

The present invention relates to a stitch presser in a knitting machine.

BACKGROUND ART

In weft knitting machines with numerous aligned knitting needles on a needle bed, provided with swinging sinkers in between the knitting needles, when a knitting needle is raised to knit a new stitch on a previously knitted stitch hooked by a stitching needle in the course of knitting performed by the knitting machine, a pressing device such as a swinging sinker or a stitch presser for pressing a stitch or a piece of knitted fabric is provided so as to prevent the stitch hooked by the knitting needle from being raised along with the raising motion of the knitting needle.

In the swinging sinker, a knitting yarn retaining section is formed and the knitting yarn of the stitch is retained by the effect of the knitting yarn retaining section. For example, when the knitting operation is performed, the hooked stitch is thereby able to pass over a position for clearing a knocking-over.

However, it has been difficult for the knitting yarn retaining section of the swinging sinker to retain the stitch in the case of knitting rib stitches using a needle bed in which the knitting needles face each other in a front to back arrangement, and further, in the case of knitting a rib-knitted fabric in which the length of a jump-stitch between knitting needles is short, or the like.

In addition, it is also considered possible to retain the stitch by providing a stitch pressing device at a carriage side that would function as a presser bar applied to a mouth portion of the knitting area. However, because there is only a slight gap in a mouth portion in which part of the swinging sinker is protruding thereto, it is extremely difficult to provide the presser bar in the mouth portion of the weft knitting machine such that the presser bar performs an advancing and retracting motion, in which a directional switching of the reciprocating motion of the carriage is performed at an arbitrary position on the needle bed.

To solve the above-mentioned problems, the applicant of the present invention previously proposed a weft knitting machine, in which the swinging sinker and the presser bar advance and retract to the mouth portion of the needle bed in a relative movement in, for example, Japanese Examined Patent Application Publication No. 6-72347.

That is, the weft knitting machine described in Japanese Examined Patent Application Publication No. 6-72347, proposed previously, has a sinker swinging motion control mechanism and a stitch presser control mechanism that move together and are installed on a carriage, and a stitch bar being supported by the stitch presser control mechanism is disposed adjacent to an upper end of the carriage such that the presser bar can be moved by the motion of the stitch presser control mechanism in an advancing and retracting motion toward the mouth portion disposed adjacent to a top portion of the needle bed. In addition, the sinker is swung by the sinker swinging motion control mechanism that interlocks with the stitch presser control mechanism. Further, the sinker and the presser bar are controlled to be driven in the advancing and retracting motion relative to each other when a directional switching of the reciprocating motion of the carriage is performed.

According to the weft knitting machine proposed previously by the inventor of the present invention, the advancing and retracting motion of the presser bar toward the mouth portion performed by the stitch presser control mechanism in conjunction with the sinker swinging motion control mechanism is performed by directional switching of the rotation of a motor. Therefore, in the course of knitting the fabric, the presser bar of the stitch presser following the advancing direction of the carriage is advanced into the mouth portion.

Consequently, when a malfunction, such as damage of a knitting cam in the carriage or the like, occurs in the course of knitting and electric power supplied to the motor is stopped resulting in a suspension of the operation of the weft knitting machine, the presser bar remains advanced into the mouth portion.

When the presser bar of the stitch presser remains advanced into the mouth portion, the carriage is moved toward the left side so as to allow the replacement of the knitting cam in the carriage and is moved across a bracket supporting a turning rail. In addition, when the carriage is dismounted from the weft knitting machine, it is possible for the presser bar to collide with the bracket.

In such a case, there is a problem in that it is troublesome to resume operation, because the presser bar is required to be detached by dismantling the same or the carriage is required to be moved while manually rotating a motor shaft while continuing to prevent the collision of the presser bar with the bracket.

The present invention was made in light of the above-described problems. The object of the present invention is that the carriage can be easily moved when the carriage is required to be moved across the bracket to allow the replacement of the knitting cam in the carriage, or the like, in a state in which the electric power being supplied to the motor has been stopped.

DISCLOSURE OF INVENTION

The present invention provides a stitch presser in a weft knitting machine to realize the above-described object, in which the stitch presser in a weft knitting machine is installed on a carriage that slides in a reciprocating fashion on a needle bed and configured such that a presser bar fitted through a presser bar supporting arm joined to the rotating shaft of a motor is advanced into a mouth portion of the weft knitting machine by electric power supplied to the motor driving the predetermined presser bar in conjunction with the directional switching of the reciprocating motion of the carriage, and a rotation energizing mechanism for rotating the rotating shaft of the motor to a side for retracting the presser bar from the mouth portion when the electric power is not supplied to the motor driving the presser bar advanced into the mouth portion is provided.

Further, in the present invention, the rotation energizing mechanism is formed of a spiral spring or a coil spring, in which an end thereof is joined to a rotation shaft of the motor or a member joined thereto and the other end is joined to a fixing member of the carriage side.

BEST MODE FOR CARRYING OUT THE INVENTION

Hereinbelow, with reference to the drawings, the best mode for carrying out the invention is explained.

Figure 1:
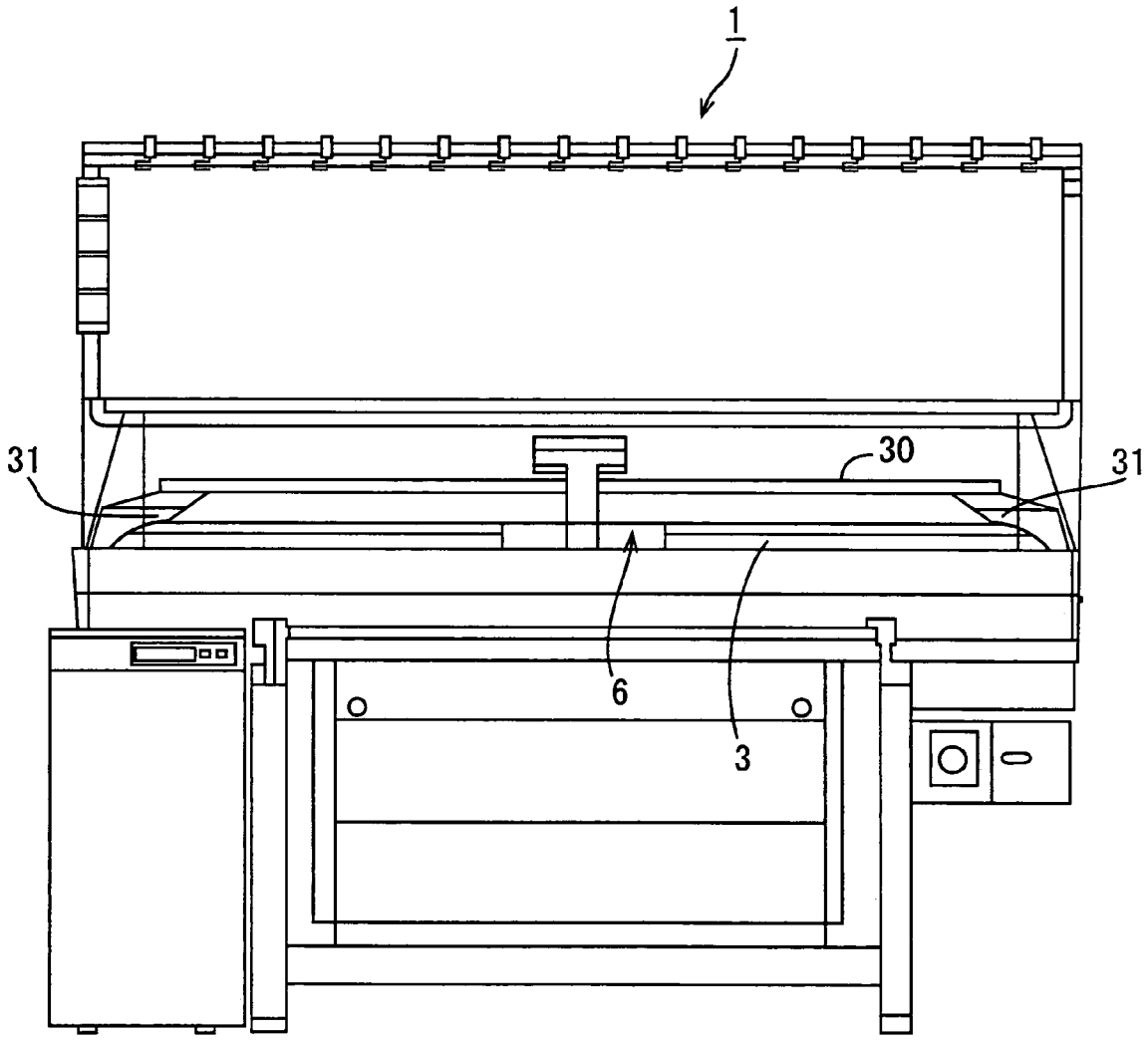
FIG. 1 is a front elevation illustrating a weft knitting machine in which a stitch presser of the present invention is incorporated.
Figure 2:
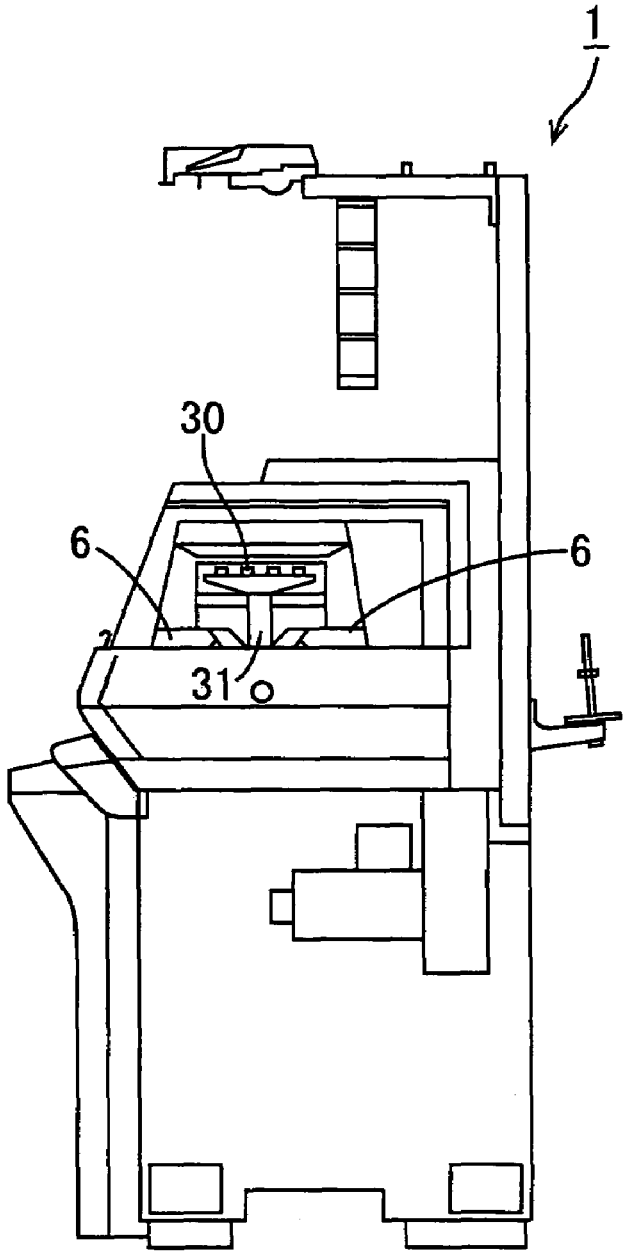
FIG. 2 is a side view illustrating the weft knitting machine in which the stitch presser of the present invention is incorporated.

FIG. 1 is a front elevation illustrating a weft knitting machine in which a stitch presser of the present invention is incorporated, FIG. 2 is a side view of the same and reference numeral 1 entirely denotes a weft knitting machine.

Figure 3:
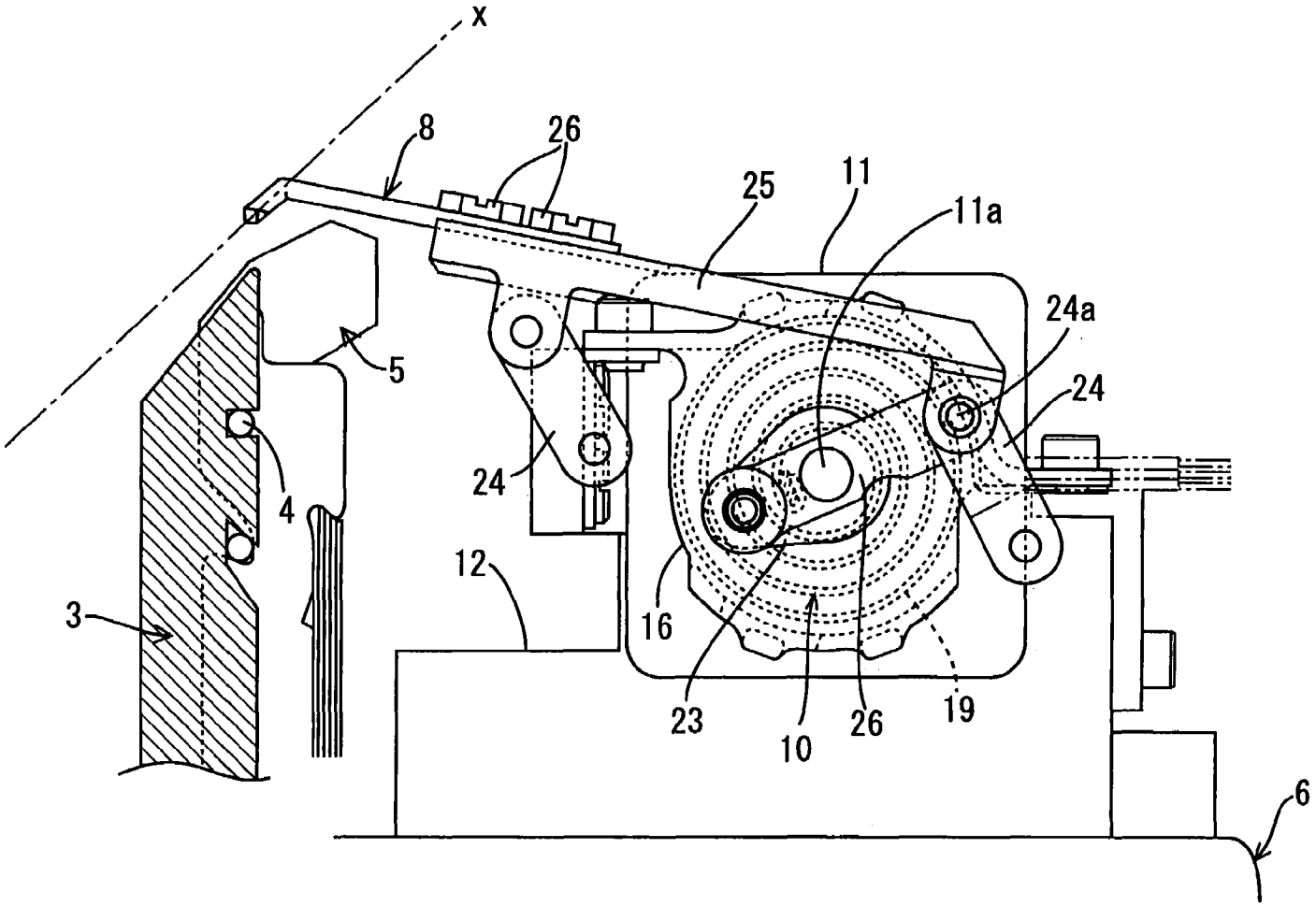
FIG. 3 is a side view illustrating a section of the stitch presser of the present invention.
Figure 4:
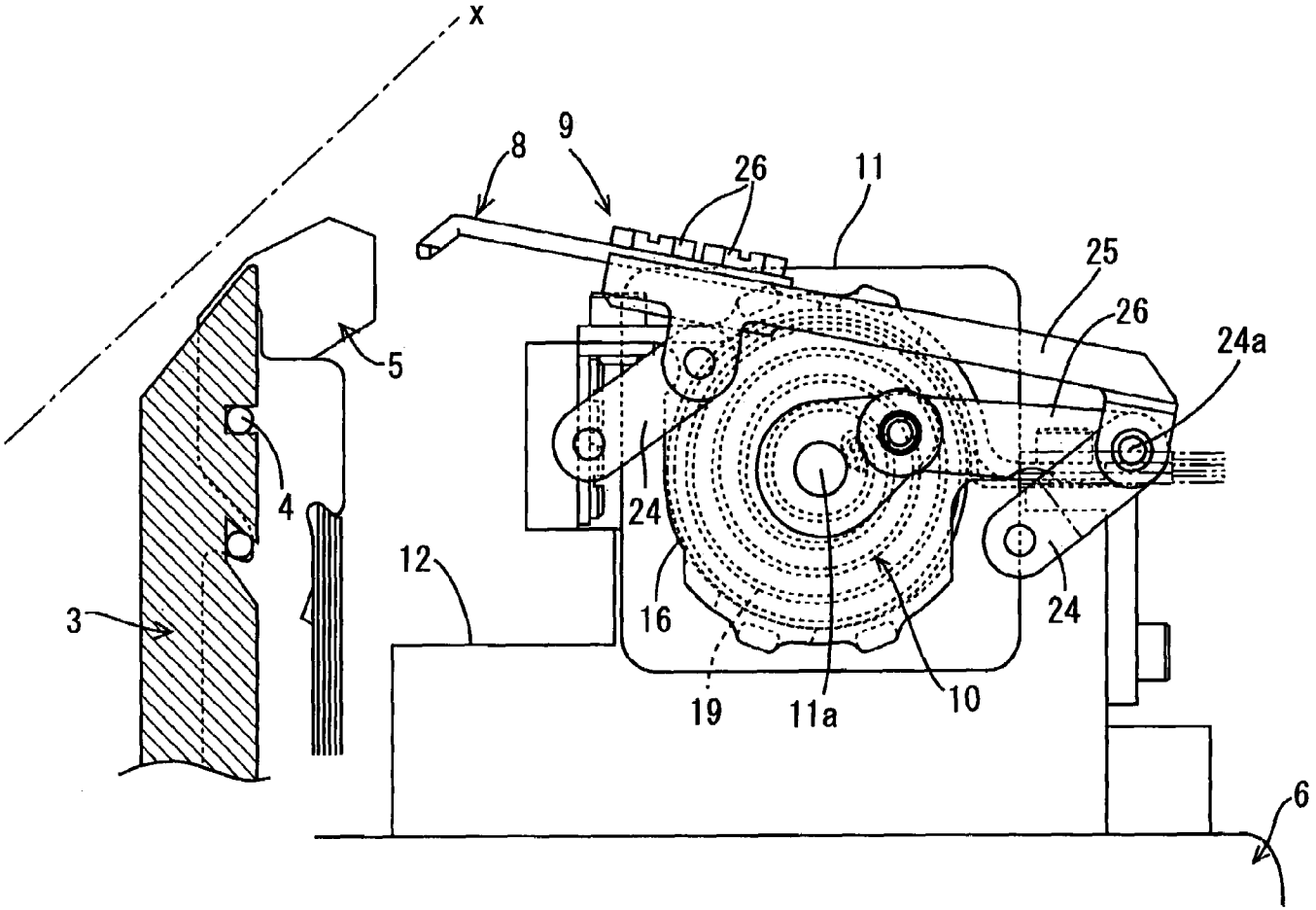
FIG. 4 is a side view illustrating a retracted state of the stitch presser of the present invention.

As illustrated in FIGS. 3 and 4, the weft knitting machine 1 is provided with a pair of needle beds 3, 3, (one side is not shown) in a front to back arrangement across a center line X of a mouth portion 2 as a line of symmetry of a upside-down letter V. Further, numerous knitting needles (not shown) are housed and are able to slide in an advancing and retracting motion in each of the needle beds 3, 3.

Each sinker 5 is disposed between knitting needles and fixed on a piano wire 4 in a longitudinal direction of the needle bed 3 and a pair of carriages 6 (shown in FIG. 1) is provided to be moved in reciprocating motion capable of being reversed at an arbitrary position by a driving device (not shown).

Figure 5:
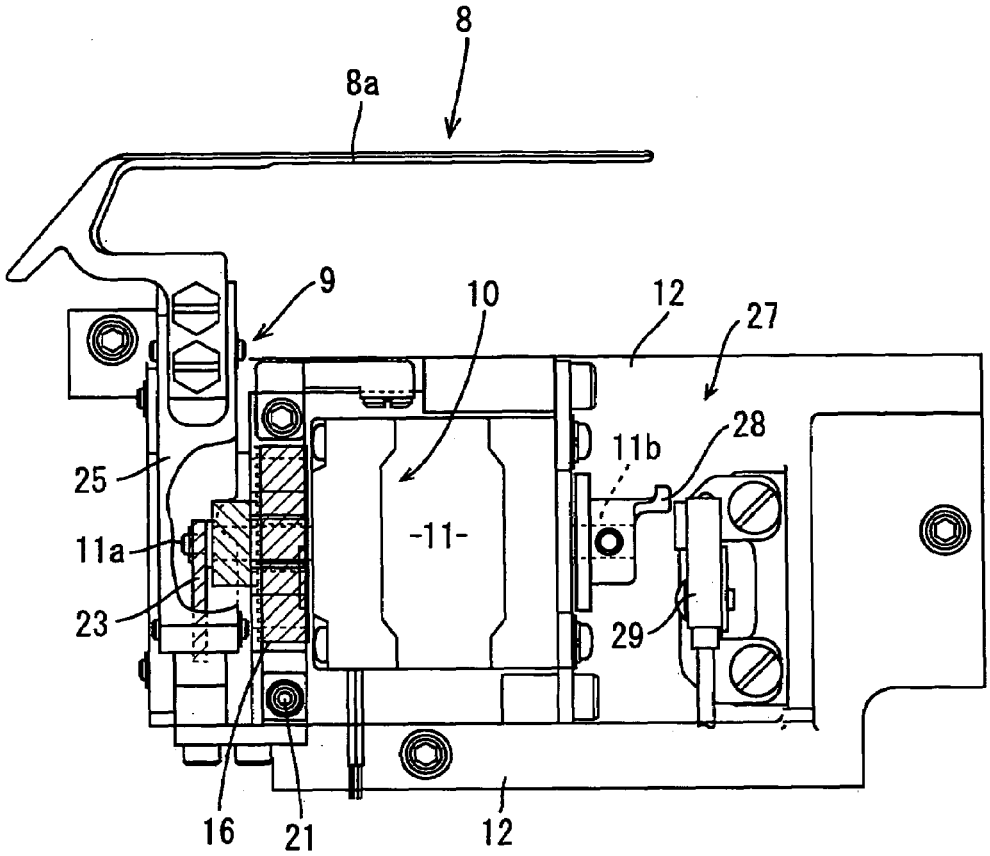
FIG. 5 is a plan view illustrating a section of the stitch presser of the present invention.
Figure 6:
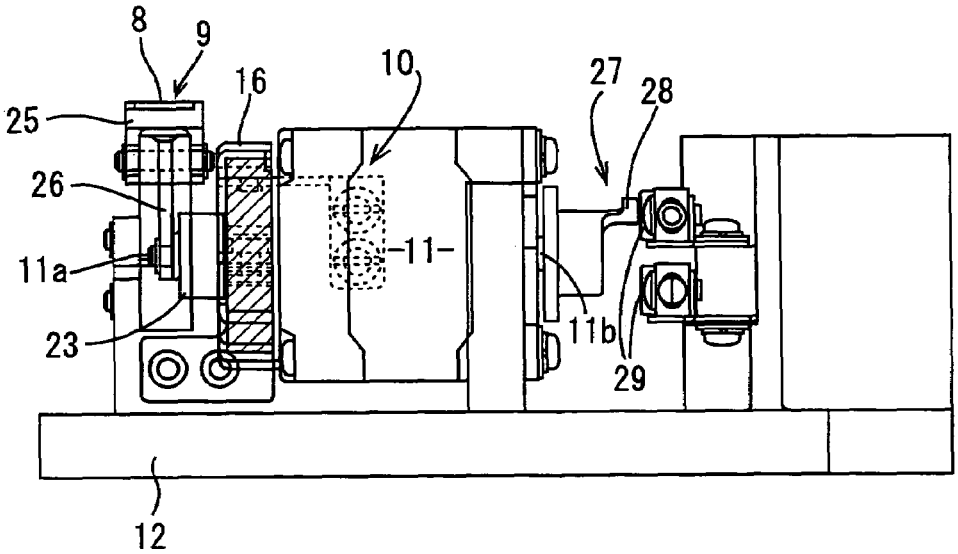
FIG. 6 is a rear elevation illustrating a section of the stitch presser of the present invention.

At the right and left upper ends of each of the carriages 6 in the weft knitting machine 1, as illustrated in FIGS. 5 and 6, a stitch presser control mechanism 9 for operating a presser bar 8 is provided and is composed of a rotation energizing mechanism 14 mounted on an output shaft 11*a* of a motor 11 of a driving device 10 and a swinging link mechanism 15 of the presser bar 8, as illustrated in FIGS. 3 through 7.

Figure 7:
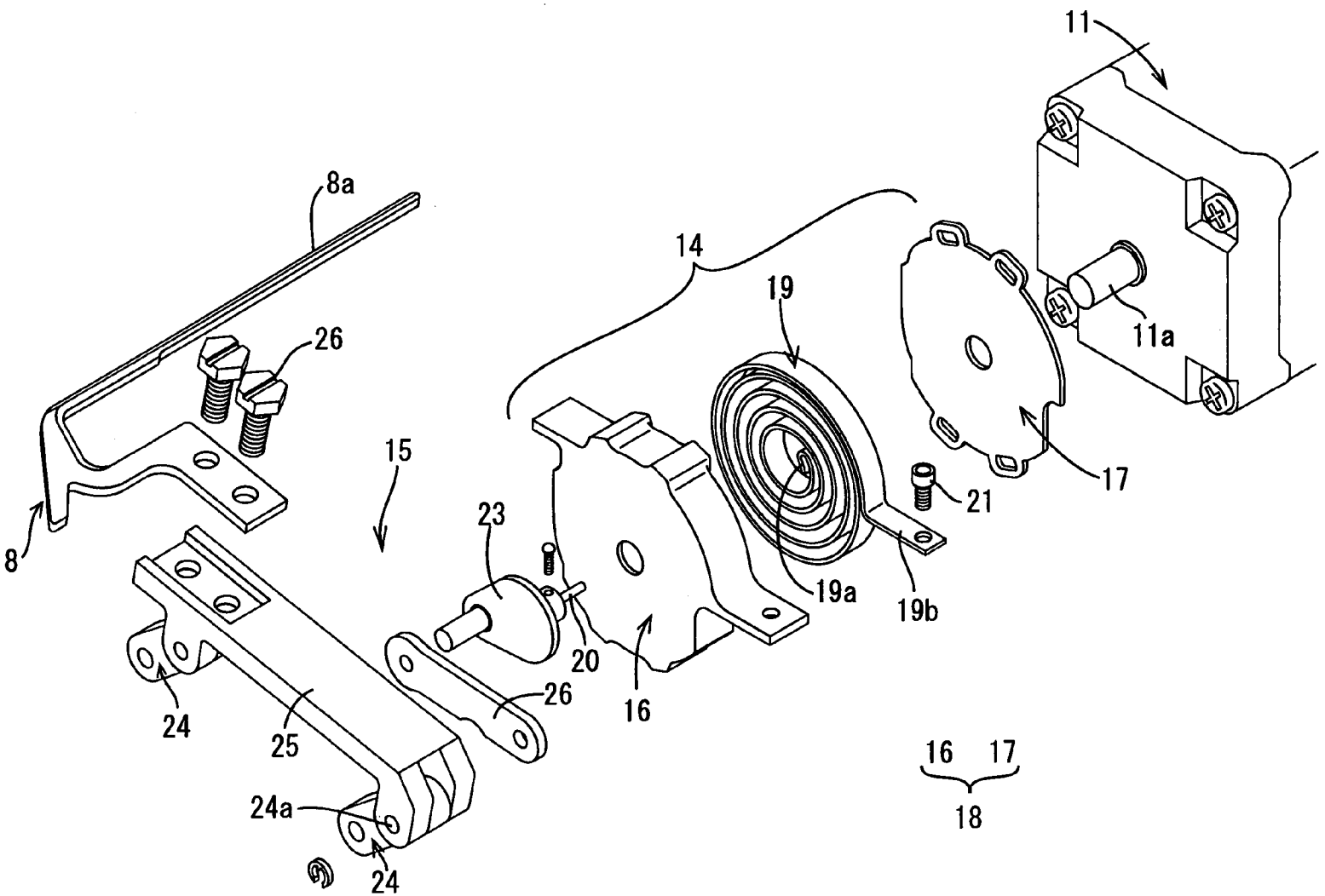
FIG. 7 is an exploded perspective view illustrating a section of a rotation energizing mechanism of the present invention.

As illustrated in FIG. 7, the rotation energizing mechanism 14 is provided for rotating the output shaft 11*a* of the motor 11 to a side for retracting the presser bar 8 from the mouth portion 2 of the weft knitting machine 1 when electric power is not supplied to the motor 11, and a casing 18 composed of a housing 16 made of synthetic resin, in which space for containing a spring is formed inside thereof, and a thin metal lid 17 for covering an opening of the housing 16, in which a spiral spring 19 is contained, are provided.

The spiral spring 19 is fixed to a fixing pin 20 formed on an operation arm 23, described later, which is mounted on the output shaft 11*a* of the motor 11 at an end 19*a* at the center of the spiral spring and the other end 19*b* at the periphery of the spiral spring is fixed to the housing 16 (a fixing member of a carriage side) with a fixing member 21.

The above-described swinging mechanism 15 of the presser bar 8 is composed of a pair of front and back parallel link plates 24, 24, which are rotatably supported by fixing members (not shown) at the carriage 6 side at their lower ends, a presser bar supporting arm 25 supported by the upper ends of the parallel link plates 24, 24, an operation rod 26 that pushes and pulls a rotatable supporting portion 24*a* at an upper end of one of the parallel link plates 24, 24 (at the upper right part in FIG. 3) by means of a rotating force of the operation arm 23 attached to the output shaft 11*a* of the motor 11, and a position detecting mechanism 27, as illustrated in FIGS. 3 through 7.

Further, the shape of the presser bar 8 is approximately the same as the shape of the conventional presser bar 8 having a fabric pressing portion 8*a* in the weft knitting machine proposed previously by the inventor of the present invention, and is attached to an end portion of a side of the mouth portion 2 of the presser bar supporting arm 25 by a fixing member.

A length of one of the parallel link plates 24, 24, which is joined to the operation rod 26, is larger than that of the other parallel link plate 24 and the fabric pressing portion 8*a* of the presser bar 8 thereby performs advancing and retracting swing in the manner of drawing an arc.

The position detecting mechanism 27 is composed of a detecting piece 28 attached to an output shaft 11*b* of the motor 11 projecting to the opposite side of the motor 11 and two proximity sensors 29, 29 for detecting the detecting piece 28, as illustrated in FIGS. 5 and 6.

One of the proximity sensors 29, 29 serves as a detector for detecting the approach of the presser bar 8 into the mouth portion 2 and the other proximity sensor 29 serves as a detector for detecting the withdrawal of the presser bar 8 from the mouth portion 2.

In the thus configured weft knitting machine, the knitted fabric is produced while the carriage 6 is reciprocatingly sliding on the needle beds 3, 3. However, when the direction of the reciprocating motion of the carriage 6 is switched, the presser bar 8 is changed to the other presser bar 8 that follows the direction of the reciprocating motion of the carriage 6 when the stitch presser is used for knitting the fabric. Therefore, one of presser bars 8 remains in the mouth portion 2, as illustrated in FIG. 3.

Figure 8:
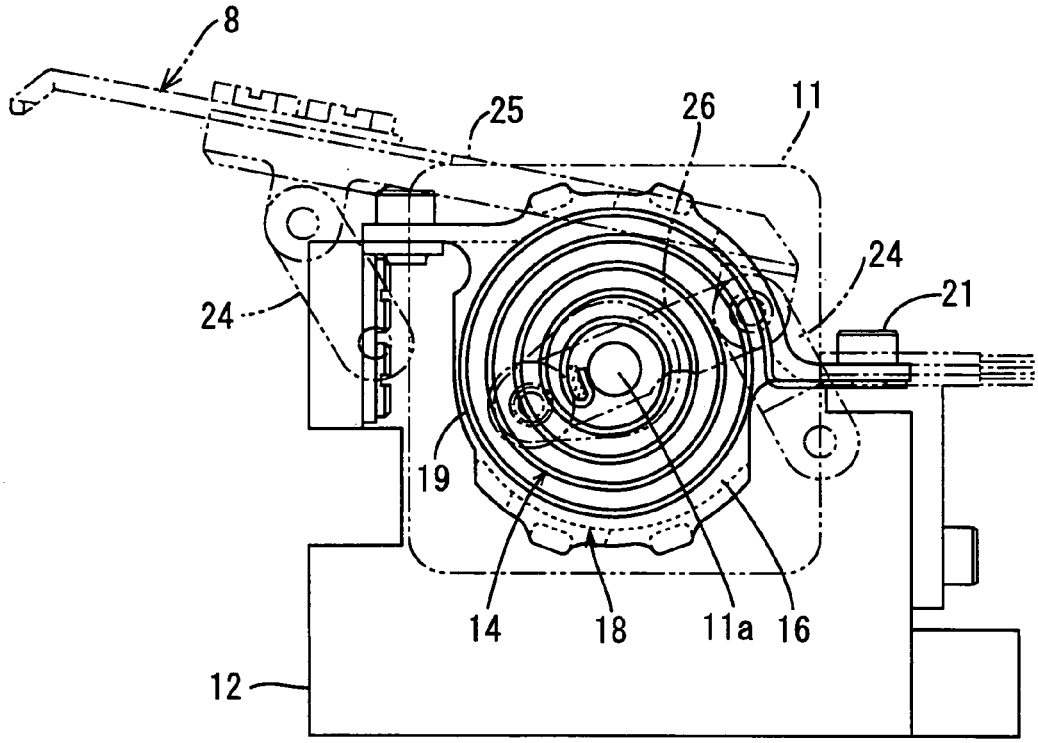
FIG. 8 is a side view illustrating a section of the rotation energizing mechanism of the present invention.

Further, in a state that the presser bar 8 remains in the mouth portion 2, the spiral spring 19 is in a state of being wound up by a rotation of the output shaft 11*a* of the motor 11 resisting an elastic force thereof until the proximity sensor 29 of the position detecting mechanism 27 for detecting the approach of the presser bar 8 detects the detecting piece 28 attached to the output shaft 11*b* of the motor 11, as illustrated in FIG. 8.

Figure 9:
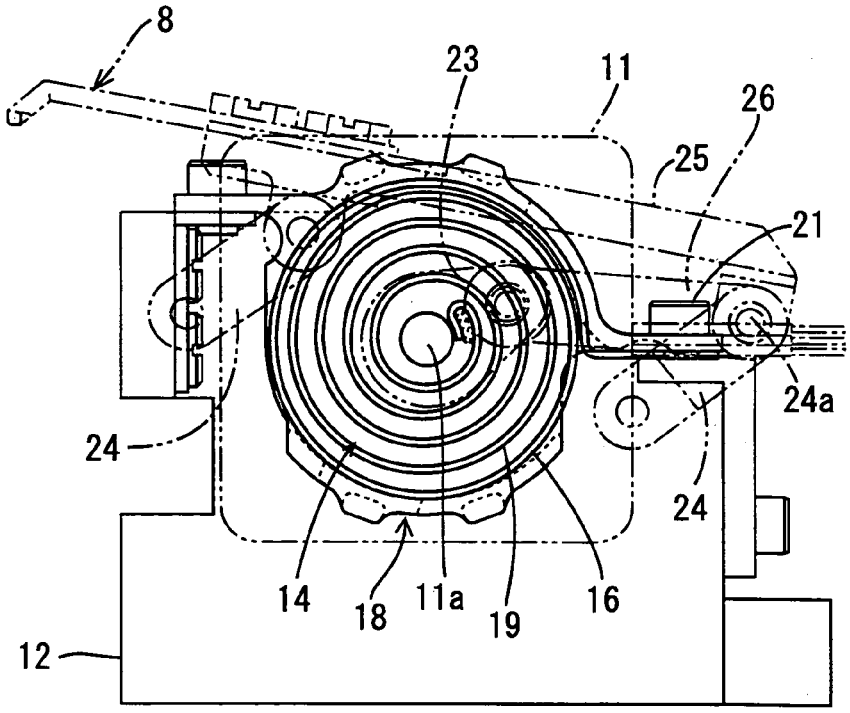
FIG. 9 is a side view illustrating a state, in which the stitch presser in a section of the rotation energizing mechanism of the present invention is retracting.

In the state mentioned above, when the electric power supplied to the motor 11 is stopped, the output shaft 11*a* of the motor 11 is disengaged and the output shaft 11*a* of the motor 11 is reversed by the elastic force of the spiral spring 19, as illustrated in FIG. 9. As a result, the presser bar 8 is brought to a state of being retracted from the mouth portion 2 in FIG. 4 from the state of remaining in the mouth portion 2 in FIG. 3.

Thus, when the presser bar 8 is brought to the state of being outwardly retracted from the mouth portion 2, the carriage 6 is prevented from colliding with a supporting bracket 31 for supporting a turning rail 30, shown in FIGS. 1 and 2, even when the carriage 6 has been detached from the needle bed 3.

In addition, although the spiral spring is used in the embodiment described above, the shape of the spring is not limited to a spiral and a coil spring having a circular cross section can of course be used.

As explained above, the stitch presser in the weft knitting machine of the present invention is provided with the rotation energizing mechanism for rotating the rotation shaft of the motor to a side for retracting the presser bar from the mouth portion of the weft knitting machine when the electric power supplied to the motor is stopped. Therefore, when, for example, a malfunction occurs in the weft knitting machine and the electric power to be supplied to the weft knitting machine is stopped, the drive of the motor that was driving the presser bar to advance into the mouth portion is stopped. Then, the rotation shaft of the motor is disengaged so that it rotates freely, and is rotated in such a direction that the presser bar can be retracted from the mouth portion by the rotation energizing mechanism.

Consequently, because the presser bar is retracted from the mouth portion, the carriage can be moved across the bracket without restriction so as to be detached from the weft knitting machine for an unexpected replacement of the knitting cam, or the like. Therefore, it is advantageous that the trouble and time required for moving the carriage to be detached from the weft knitting machine can be reduced.

The invention claimed is:

1. A stitch presser in a weft knitting machine installed on a carriage that slides in a reciprocating fashion on a needle bed and configured such that a presser bar is advanced into a mouth portion of the weft knitting machine in response to rotation of a rotating shaft of a motor with electric power supplied to the motor driving the predetermined presser bar in conjunction with a directional switching of the reciprocating motion of the carriage, comprising: a rotation energizing mechanism for rotating the rotation shaft of the motor to a side for retracting the presser bar from the mouth portion of the weft knitting machine when the electric power is not supplied to the motor for driving the presser bar advanced into the mouth portion.

2. The stitch presser in a weft knitting machine according to claim 1, wherein the rotation energizing mechanism is formed of a spiral spring or a coil spring, and wherein an end thereof is joined to the rotation shaft of the motor or a member moving in response to rotation of the motor, and the other end thereof is joined to a fixing member of the carriage side.

* * * * *